United States Patent [19]

Svoboda et al.

[11] 4,132,426

[45] Jan. 2, 1979

[54] DEVICE FOR FASTENING AN ATTACHMENT TO A SKI

[75] Inventors: Josef Svoboda, Schwechat; Karl Stritzl, Vienna, both of Austria

[73] Assignee: TMC Corporation, Baar/Zug, Switzerland

[21] Appl. No.: 812,671

[22] Filed: Jul. 5, 1977

[30] Foreign Application Priority Data

Jul. 16, 1976 [AT] Austria ..... 5237/76

[51] Int. Cl.[2] ..... A63C 11/00

[52] U.S. Cl. ..... 280/11.37 E; 248/221.3; 248/223.1; 280/633

[58] Field of Search ..... 280/11.37 E, 11.37 R, 280/633, 601, 607; 248/220.2, 221.3, 222.1, 222.4, 223.1

[56] References Cited

U.S. PATENT DOCUMENTS 3,392,848 7/1968 McConnel et al. ..... 248/223.1 X 3,910,593 10/1975 Schwarz ..... 280/11.37 E 3,977,688 8/1976 Imagawa ..... 280/633

*Primary Examiner*—Robert R. Song

*Assistant Examiner*—Milton L. Smith

*Attorney, Agent, or Firm*—Blanchard, Flynn, Thiel, Boutell & Tanis

[57] ABSTRACT

A lock mechanism for releasably securing an anti-crossing device for skis to the upper surface of a ski so that the member which is affixed to the ski does not have any dangerous projections thereon once the anti-crossing device has been removed from the ski. The anti-crossing device cooperates with a fastening plate secured to the ski, which fastening plate has slots therein into which are received pins mounted on the anti-crossing device. A locking pin is reciprocally movable on the anti-crossing device and is received into an opening in the fastening plate and is resiliently held in position to maintain the pins in engagement with the slots.

13 Claims, 8 Drawing Figures

DEVICE FOR FASTENING AN ATTACHMENT TO A SKI

FIELD OF THE INVENTION

The invention relates to a device for the fastening of an attachment member to a ski for preventing the crossing of skis, wherein between the attachment member and the ski there is provided at least one adhesive joint and at least one rubber-elastic layer, the base of which corresponds preferably to the adhesive joint, wherein one side of a fastening plate is glued to the ski and with its other side is associated with the layer, and wherein between the fastening plate and the attachment member there is provided at least one releasable locking member.

BACKGROUND OF THE INVENTION

A device of the abovementioned type is described in U.S. Pat. No. 3,910,593. At least one extension is provided on the fastening plate in the known device, a locking member being secured to the end of said extension so that after removal of the attachment member a substantially vertical upwardly projecting structural element projects away from the upper surface of the ski and this can easily cause injuries or damages. Moreover, fastening of a locking member to the free end of the extension creates also an additional amount of work and expense. In the illustrated exemplary embodiments of the abovementioned device further solutions are described which need the use of additional holding and/or locking elements.

The purpose of the invention is to improve the device of the abovementioned type so that it does not have the mentioned disadvantages. Moreover, a simple solution of the locking member is made possible in particular without reducing the holding capability.

The set purpose is inventively attained by the combination of at least one insert slot and one coupling pin which can engage said slot and a springy lock, wherein the insert path of the coupling pin and the operating path of the lock lie in two planes which are perpendicular with respect to one another.

The inventive construction produces a device in which, after removal of the attachment member from the upper side of the ski, only an insert slot which slightly rises from the ski projects therefrom. This practically eliminates any danger as to injury and also damage of a different article is reduced to a minimum. Installation and removal can be carried out quickly and simply by overcoming the spring force.

BRIEF DESCRIPTION OF THE DRAWINGS

Further advantages and details of the invention will be discussed more in detail now with reference to the drawings which show two exemplary embodiments.

In the drawings:

FIGS. 1 to 4 illustrate a first exemplary embodiment of the inventive device, wherein FIGS. 1 and 2 or FIGS. 3 and 4 are associated views, FIGS. 1 and 3 being cross-sectional views taken along the line I—I of FIG. 2 and along the line III—III of FIG. 4, respectively, and FIG. 2 is a top view of FIG. 1 and FIG. 3 is a top view of FIG. 4, and FIGS. 1, 2 illustrate the closed position whereas FIGS. 3, 4 illustrate the open position;

DETAILED DESCRIPTION

Figure 1:
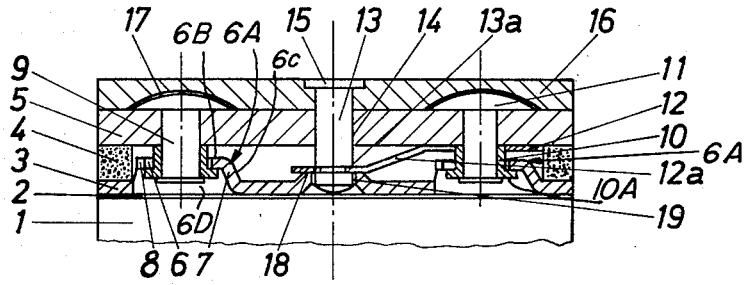

The component parts which are the same in the two embodiments will in the following description have the same reference numerals, however, the parts which are designed differently but serve one and the same purpose will receive a prime (') suffix for the purpose of differentiating therebetween.

As will be recognized from the first exemplary embodiment according to FIGS. 1 to 4, a fastening plate 3 is glued by means of an adhesive 2 on the upper surface of a ski 1, part of which is shown in the drawing. A two-sided adhesive tape can, for example, be used as the adhesive. An attachment member 5, the contour of which is only indicated, is placed onto the fastening plate 3 by interpositioning of an elastic plate 4, for example rubber.

Figure 8:
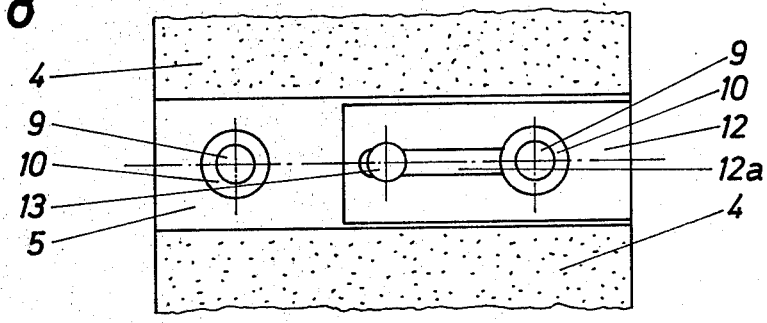
FIG. 8 is a bottom view with the fastening plate being omitted.

To hold down the attachment member 5 onto the fastening plate 3, the fastening plate 3 has a pair of raised portions 6A each having an upper wall 6B, a sidewall 6C and a cavity 6D therebeneath. Each raised portion 6A has an insert slot 6 in the upper wall thereof which is preferably punched out of the material of the fastening plate 3 and has a first segment 6E extending transversely of the longitudinal axis of the ski in the upper wall 6B and a second segment 6F in the sidewall 6C. The insert slots 6 each have for an easier introduction of cooperating coupling pins 9 at its open sides upwardly and inwardly extending sloped sections 7 and 8, respectively. The coupling pins 9 have mounted thereon at their ends which are received in the insert slots 6 riveted holding sleeves 10 and at the ends which are remote from the insert slots 6 rounded-off holding heads 11. The holding sleeves 10 have a flange 10A of a diameter greater than the first segment 6E of the slot 6 and less than the second segment 6F. A leaf spring 12 is held in place by one of the holding sleeves 10 and is designed as a slightly initially tensioned leaf spring and is fixedly connected at with its free end to a lock pin 13. The lock pin 13 is movably held in vertical alignment in an associated bore 14 in the attachment member 5 and terminates in a head 15 which is supported in a handle 16. The handle 16 has recesses 17 at two locations thereon which are alignable with the heads 11 of the coupling pins 9. The lock pin 13 has a notch **13*a* therein adjacent the lower end thereof and cooperates with the spring 12; to introduce the spring 12 into the notch 13*a* the spring has a longitudinal slot 12*a* (see FIG. 8**) therein.

Figure 2:
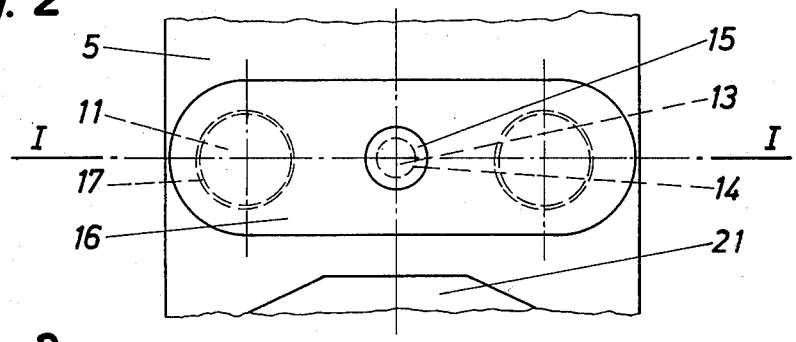
Figure 3:
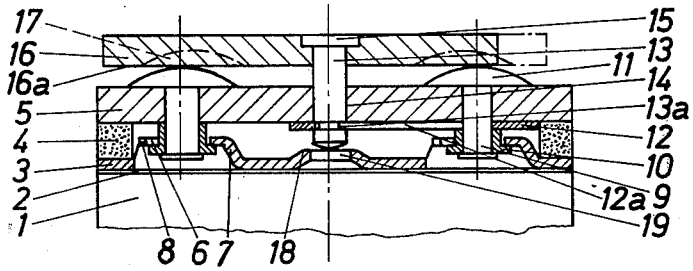
Figure 4:
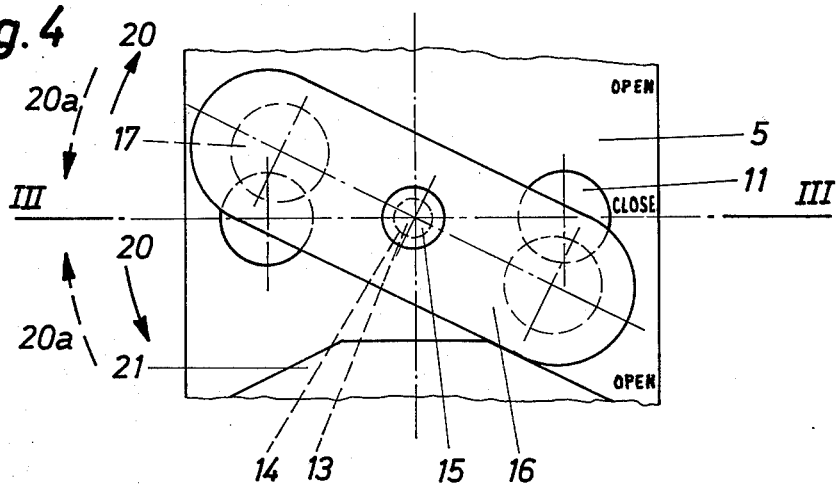

The fastening plate 3 has furthermore an impression or dimple 18 from the underside which is located centrally with respect to the insert slots 6. The impression 18 has an opening 19 therein to receive the lower end of the lock pin 13. If the lock pin 13 is positioned, under the spring force of the spring 12, in the opening 19 of the impression 18, then the attachment member 5 is locked to the ski by the coupling pins 9 in the insert slots 6. This position is illustrated in FIGS. 1 and 2. The recesses 17 in the handle 16 rest thereby snugly on the heads 11 and the handle 16 itself on the upper surface of the support member 5. If the handle is rotated clockwise in the direction of the arrow 20 (see FIG. 4), so that now the flat underside **16*a* of the handle 16 runs up onto the heads 11 of the coupling pins 9 and comes to rest on same (see FIG. 3), then the lock pin 13 is lifted against the force of the spring 12 out of the opening 19 in the impression 18 so that the connection between the fastening plate 3 and the attachment member 5 is cancelled. As a result, the coupling pins 9 can be moved out in a direction toward the free opened ends of the insert slots 6, so that the attachment member 5** can be easily removed.

It is now understandable that when the attachment member 5 is removed, the handle 16 can both remain in this position and be swung back into the so-called closed position. In the latter case, the spring 12 will be under a small initial stress; to effect an attachment of the attachment member 5, the handle 16 must then again be rotated counter-clockwise in direction of the arrow 20, so that the lock pin 13 reaches the lifted position in order to be able to bring the attachment member 5 again into engagement with the insert slots 6 by means of the coupling pins 9. For closing, the handle 16 must be swung back in direction of the dashed arrow 20*a*. To define the path of swing of the handle 16 and to prevent the handle 16 from leaving the area of the heads 11 of the coupling pins 9, a stop 21 is provided on the upper side of the attachment member 5. The stop 21 can be constructed of the same material as the attachment member 5 or it may be secured as a separate part on same. With respect to operation, it does not matter in principle whether the release takes place in direction of the arrow 20 or in direction of the arrow 20*a;* closing must always take place in the opposite direction. It is also possible to mark the opened or closed position with arrows and/or indicia indicating "closed" or "open".

Figure 5:
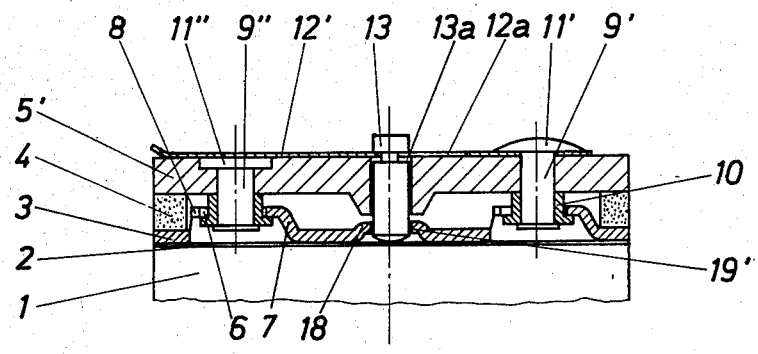
FIGS. 5 and 6 are each cross-sectional views of a second exemplary embodiment, corresponding with the positions according to FIG. 1 and FIG. 3, respectively.
Figure 6:
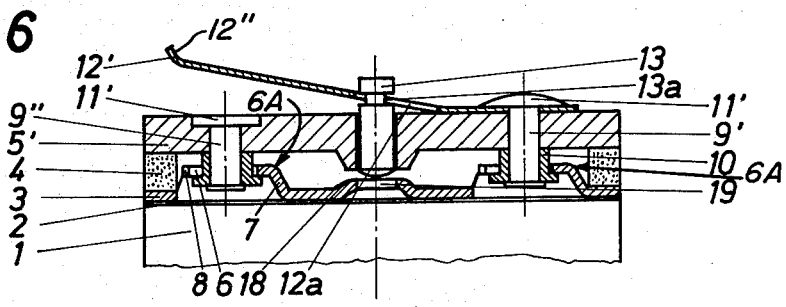
Figure 7:
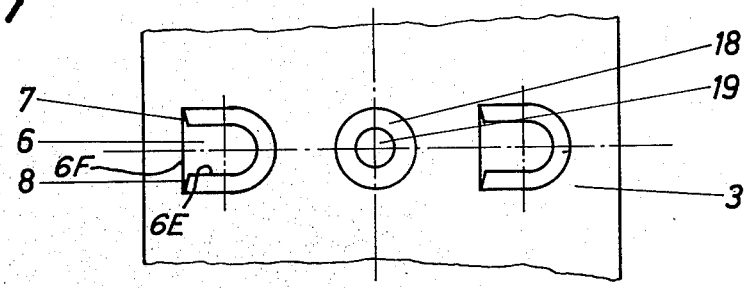
FIG. 7 is a top view of the fastening plate without the attachment member.

In the embodiment according to FIGS. 5 and 6, the difference over the previous embodiment consists substantially in a spring 12' being held down on the upper surface of the attachment member 5 by the head 11' of a coupling pin 9', wherein the notch 13*a* is provided adjacent the upper end of the lock pin 13'. An upturned flange 12'' is provided on the free end of the spring 12' and serves as a handle. In this case, the other coupling pin 9'' is secured with a countersunk head 11'' so that it is flush with the attachment member 5. Further details correspond to the aforedescribed.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In combination, an attachment member for a ski and a device for fastening said attachment member to a ski, said combination comprising:

a fastening plate and first fastening means for fastening said fastening plate to said ski, said fastening plate having at least one raised portion thereon with an upper wall, encircling sidewall means and a cavity therebeneath;

first means defining an elongate insert slot in said raised portion and communicating with said cavity, the longitudinal axis of said elongate slot extending transversely of the longitudinal axis of said ski, said insert slot having an elongated first segment located in said upper wall of uniform width and a sidewardly opening second segment in said sidewall means of a width greater than said uniform width, both of said first and second segments of said insert slot communicating with said cavity;

second means defining a first opening in said fastening plate adjacent to said raised portion;

an elastic plate positioned between said attachment member and said fastening plate;

at least one coupling pin mounted on said attachment member and having a diameter less than said uniform width of said first segment, said coupling pin having an enlarged end on one end thereof of a width greater than said uniform width of said first segment and less than the width of said second segment, said enlarged head being received in said cavity through said second segment when said attachment member is superposed on said elastic plate;

a locking member and mounting means for mounting said locking member to said attachment member, said mounting means including means defining a second opening in said attachment member coaxial with said first opening in said fastening plate when said attachment member is superposed on said elastic plate, said locking member being slidably disposed in said second opening and movable between a first position retracted from said first opening and a second position received in said second opening, said locking member when in said second position preventing a movement of said attachment laterally of said longitudinal axis of said ski and a removal of said enlarged head from said cavity through said second segment to thereby effect a locking of said attachment member to said fastening plate;

resilient means connected to said locking member and said attachment member for continually urging said locking member into said second position; and manually engageable means connected to said locking member for facilitating a movement of said locking member to said first position against the urging of said resilient means to permit a movement of said enlarged head laterally of said longitudinal axis of said ski through said second segment to permit a release of said attachment member from engagement with said fastening plate.

2. The combination according to claim 1, wherein two raised portions are provided on said fastening plate with each having an insert slot therein, said attachment member having two coupling pins with enlarged ends thereon, and wherein said second opening is positioned between said insert slots.

3. The combination according to claim 2, wherein said locking member is arranged centrally with respect to said coupling pins.

4. The combination according to claim 1, wherein the other end of said coupling pin is also enlarged on the opposite side of said attachment member from said one end, and wherein said manually engageable means has means thereon defining at least one recess receiving said other enlarged end, said resilient means urging said manually engageable means into engagement with said attachment member and said other enlarged end into said recess.

5. The combination according to claim 4, wherein said manually engageable means is pivotal with respect to said attachment member about the axis of said locking member, said manually engageable means being urged upwardly away from said attachment member against the urging of said resilient means as said other end of said coupling pin is moved out of said recess.

6. The combination according to claim 1, wherein said resilient means comprises a leaf spring having an elongated slot therein, said locking member having a notch therein receiving the edges of said notch.

7. The combination according to claim 1, wherein said insert slot is punched out of the material of the fastening plate and has upwardly extending slopes extending transversely of the longitudinal axis of said ski.

8. The combination according to claim 1, wherein said means defining said second opening includes an impression in said fastening plate, and wherein the height of said impression is less than the vertical path of movement of said locking member.

9. The combination according to claim 1, wherein said enlarged one end is defined by a holding sleeve having a radially extending flange thereon, and wherein said resilient means comprises a leaf spring which is secured to said coupling pin by said holding sleeve and is arranged below the underside of said attachment member.

10. The combination according to claim 1, wherein the other end of said coupling pin is also enlarged on the opposite side of said attachment member from said one end, and wherein said resilient means is a leaf spring which is secured by said other enlarged end on the upper side of said attachment member.

11. The combination according to claim 1, wherein said locking member pivotally supports said manually engageable means about the longitudinal axis thereof, and wherein in the path of swing of said manually engageable means there is arranged a stop to limit the pivoted position of said manually engageable means whereat its underside will rest on the highest point of said other enlarged end.

12. The combination device according to claim 1, wherein two raised portions are provided on said fastening plate with each having an insert slots therein, said attachment member having two coupling pins with enlarged ends on one end thereof and wherein said second opening is positioned between said insert slots;

wherein the other end of one of said coupling pins is also enlarged on the opposite side of said attachment member from said one end;

wherein said resilient means is a leaf spring which is secured at one end thereof by said other enlarged end of said one coupling pin on the upper side of said attachment member; and wherein the other coupling pin has a countersunk head flush with the upper surface of said attachment member.

13. The combination according to claim 12, wherein said manually engageable means is an upturned flange on the end of said leaf spring remote from said other enlarged end of said one of said coupling pins.

* * * * *